US006477733B1

(12) United States Patent
Kuhns

(10) Patent No.: US 6,477,733 B1
(45) Date of Patent: Nov. 12, 2002

(54) FLUID COLLECTION SYSTEM

(76) Inventor: Brian Kuhns, 24221 W. Marydale, Lake Zurich, IL (US) 60047

( * ) Notice: Subject to any disclaimer, the term of this patent is extended or adjusted under 35 U.S.C. 154(b) by 0 days.

(21) Appl. No.: 09/524,993

(22) Filed: Mar. 14, 2000

(51) Int. Cl.[7] ..... A47L 13/52
(52) U.S. Cl. ..... 15/257.3; D32/74
(58) Field of Search ..... 15/257.3, 257.4, 15/257.9, 257.1, 264; D32/74; 220/571, DIG. 6

(56) References Cited

U.S. PATENT DOCUMENTS 346,761 A * 8/1886 Marsh et al. ..... 15/257.3
1,255,902 A * 2/1918 Marriott ..... 15/257.3
1,748,336 A * 2/1930 Finnell ..... 15/257.3
2,496,735 A * 2/1950 Malone ..... 15/257.3
2,515,117 A * 7/1950 Duhaime ..... 15/257.3
2,617,281 A * 11/1952 Jones ..... 15/257.3
3,671,995 A * 6/1972 Carr ..... 15/257.1
D381,155 S * 7/1997 Powers ..... D32/74

FOREIGN PATENT DOCUMENTS

FR 1262007 * 4/1961 ..... 15/257.3

* cited by examiner

*Primary Examiner*—Gary K. Graham
(74) *Attorney, Agent, or Firm*—Kajane McManus

(57) ABSTRACT

The fluid collection system comprises a pan and a blade. The pan incorporates a ramp leading to a sump and the sump has sidewalls for containing fluid therein. One sidewall of the sump includes a spout through which fluid is emptied from the sump. The blade has a scraping edge for use in directing fluid up the ramp and into the sump. A screened cap is also provided which engages over a free end of the spout for straining fluid emptied from the sump through the spout.

7 Claims, 1 Drawing Sheet

FLUID COLLECTION SYSTEM

BACKGROUND OF THE INVENTION

1. Field of the Invention

The present invention relates to a fluid collection system. More particularly, the system is provided for use in collecting spills such as oil or transmission fluid spills.

2. Prior Art

Heretofore numerous apparatus have been proposed for use in collecting spills.

Exemplary embodiments of such apparatus can be found in U.S. Pat. Nos. 7,866; 97,276; 601,678; 2,396,645; 3,382,523, D25,079; D35,530; D145,887; D180,209; D206,276; and D381,155.

None of the prior art, however, shows a system wherein emptying of the fluid from the collection apparatus can be controlled, or filtered, if it is desired to do so.

SUMMARY OF THE INVENTION

According to the invention there is provided a fluid collection system comprising a pan and a blade; the pan incorporating a ramp leading to a sump and the sump having sidewalls for containing fluid therein, one sidewall of the sump including a spout through which fluid is emptied from the sump, and the blade having a scraping edge for use in directing fluid up the ramp and into the sump.

DESCRIPTION OF THE PREFERRED EMBODIMENT

Figure 1:
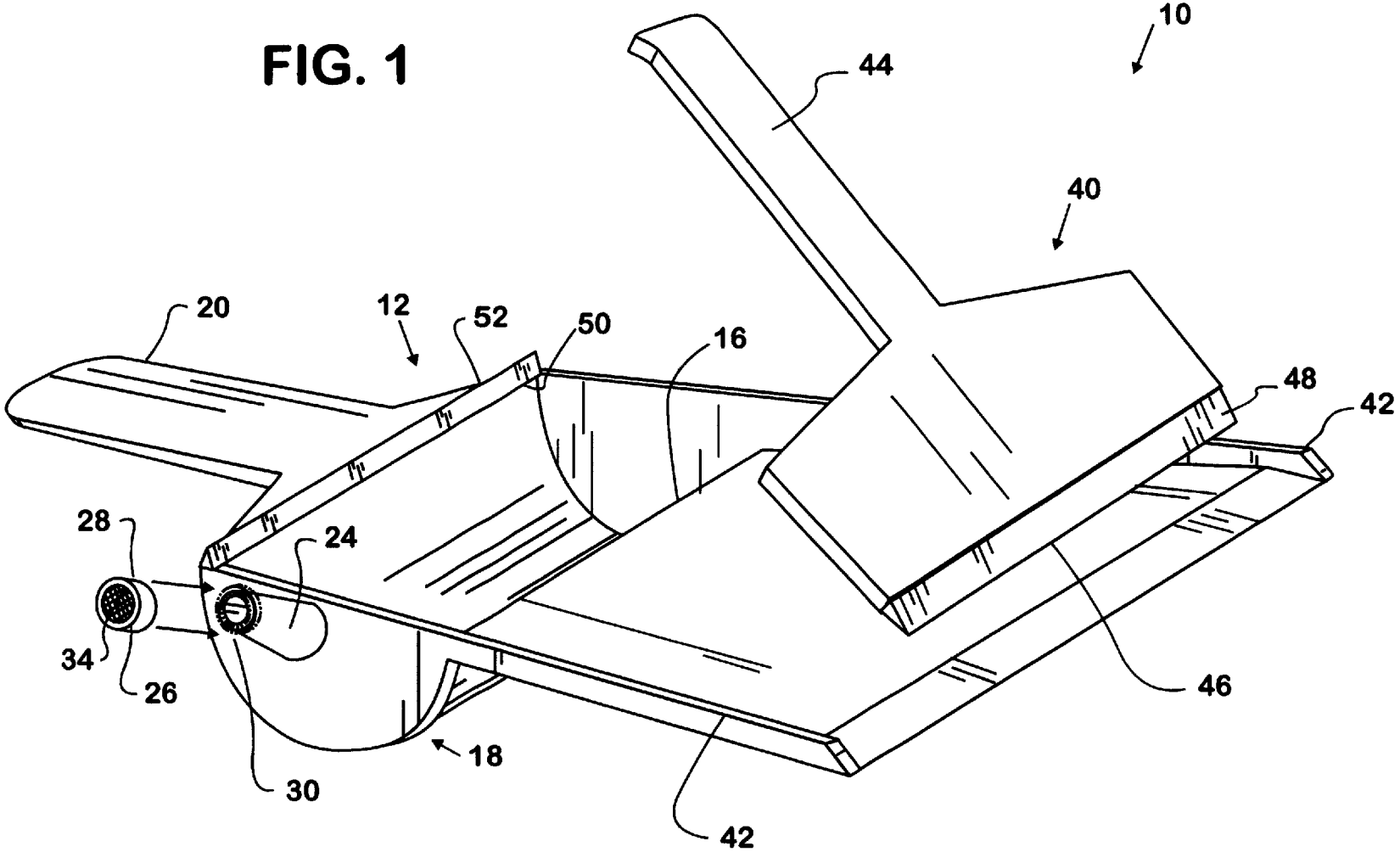
FIG. 1 is a perspective view of the fluid collection system of the present invention.

Referring now to FIG. 1 in greater detail, there is illustrated therein the fluid collection system made in accordance with the teachings of the present invention and generally identified by the reference numeral 10.

As illustrated, the system 10 is comprised of several items.

The first item is a pan 12 including a ramp 14 leading upwardly to a front lip 16 of a liquid sump 18 which drops below the level of the front lip 16. A handle 20 is provided for ease in manipulating the pan 12 into a desired position/location for use.

The liquid sump 18 includes opposed sidewalls 20 and is defined therebetween.

For ease in emptying the sump 18, one sidewall 20 is provided with a spout 24 which extends outwardly of the sidewall 20. The spout 24 is configured to receive thereon, when desired, a screen cap 26. The screen cap 26 comprises a sidewall 28 which releasably engages over a free end 30 of the spout 24, in any suitable manner such as, for example, frictionally. It will be understood that a free end 34 of the screen cap 26 is formed of a screen material, which will allow fluid to pass therethrough while entraining particulate matter within the spout 24 and/or sump 18.

The ability to strain the fluids is important when such fluids are collected for reprocessing and the like.

The second item of the system 10 is a planar blade 40 which is used to guide spilled fluid up the ramp 14, into the sump 18.

Obviously, the lateral extent of the blade 40 should be somewhat narrower than a lateral extent of the ramp 14, so that a continuous contact between the ramp 14 and blade 40 may be maintained. Further, the ramp 14 is provided with opposed elevated sidewalls 42 to keep the fluid from pouring laterally off the ramp 14.

In a preferred embodiment of the blade 40, a graspable handle 44 is provided and a scraping edge 46 of the blade 40 is comprised of a rubber squeegee element 48 which can be replaced when worn, in usual manner.

Further, in a preferred embodiment of the pan 12 a rear lip 50 of the sump 18 can be provided with a scraper 52 against which the scraping edge 46 of the blade 40 can be scraped to remove liquid therefrom which is not removed by gravitational forces as the blade 40 passes across the sump 18.

As disclosed above, the system 10 provides a number of advantages, some of which have been described above and others of which are inherent in the invention. Also modifications may be proposed to the system 10 without departing from the teachings herein. Accordingly the scope of the invention is only to be limited as necessitated by the accompanying claims.

I claim:

1. A fluid collection system comprising a pan and a blade; the pan incorporating a ramp leading to a sump and the sump having sidewalls for containing fluid therein, one sidewall of the sump including a spout through which fluid is emptied from the sump, the blade having a scraping edge for use in directing fluid up the ramp and into the sump and wherein a screen cap is provided for releasable engagement over a free end of said spout.

2. The system of claim 1 wherein said scraping edge of said blade comprises a replaceable squeegee.

3. The system of claim 1 wherein a scraper against which the scraping edge of the blade may be scraped is provided along a rear edge of said sump.

4. The system of claim 1 wherein the blade has a graspable handle.

5. The system of claim 1 wherein the pan has a graspable handle.

6. The system of claim 1 wherein the ramp has elevated sidewalls.

7. The system of claim 1 wherein the blade has a lesser lateral extent than a lateral extent of said ramp and sump.

* * * * *